US009470494B2

(12) United States Patent
Marx

(10) Patent No.: US 9,470,494 B2
(45) **Date of Patent: *Oct. 18, 2016**

(54) HIGH VOLUME MULTIPLE COMPONENT PROJECTILE ASSEMBLY

(71) Applicant: Liberty Ammunition, Inc., Bradenton, FL (US)

(72) Inventor: P J Marx, Sarasota, FL (US)

(73) Assignee: Liberty Ammuntion, Inc., Bradenton, FL (US)

( * ) Notice: Subject to any disclaimer, the term of this patent is extended or adjusted under 35 U.S.C. 154(b) by 1 day.

This patent is subject to a terminal disclaimer.

(21) Appl. No.: 14/483,873

(22) Filed: Sep. 11, 2014

(65) Prior Publication Data

US 2014/0373746 A1 Dec. 25, 2014

Related U.S. Application Data

(63) Continuation of application No. 13/657,207, filed on Oct. 22, 2012, now Pat. No. 8,857,343.

(60) Provisional application No. 61/652,653, filed on May 29, 2012.

(51) Int. Cl.
*F42B 14/02* (2006.01)
*F42B 12/76* (2006.01)
(Continued)

(52) U.S. Cl.
CPC ..... *F42B 14/02* (2013.01); *F42B 12/02* (2013.01); *F42B 12/367* (2013.01); *F42B 12/78* (2013.01); *F42B 14/00* (2013.01); *F42B 33/001* (2013.01); *F42B 30/02* (2013.01)

(58) Field of Classification Search
CPC ..... F42B 14/00; F42B 14/02; F42B 12/02; F42B 14/04; F42B 12/367; F42B 12/78; F42B 30/02; F42B 33/00; F42B 33/001
USPC ..... 102/501, 506, 514, 517, 518, 519, 520, 102/524, 526
See application file for complete search history.

(56) References Cited

U.S. PATENT DOCUMENTS 29,272 A * 7/1860 Hotchkiss ..... F42B 14/02 102/525
34,091 A * 1/1862 Alexander ..... F42B 14/02 102/525

(Continued)

OTHER PUBLICATIONS

International Search Report and Written Opinion issued Mar. 6, 2014 for corresponding PCT International Application No. PCT/US2013/043081 with an International Filing Date of May 29, 2013.

(Continued)

*Primary Examiner* — James S Bergin
(74) *Attorney, Agent, or Firm* — Anton J. Hopen; Ronald E. Smith; Smith & Hopen, P.A.

(57) ABSTRACT

A projectile includes a head, a tail, and an interface that interconnects the head and tail. Multiple sections of the interface are deformed by being compressed radially inwardly into respective annular recesses formed between the interface and the head and tail during manufacturing or by rifling when the projectile is fired. The amount of deformation is controlled by the depth of each of the annular recesses. In all embodiments, annular ridges formed in the head, the tail, or both, define the longitudinal extent of the annular recesses. The interface includes an annular obturation region and has a beveled open leading end to facilitate insertion of the head and tail into the interface.

6 Claims, 6 Drawing Sheets

(51) Int. Cl.

| | |
|---|---|
| ***F42B 30/02*** | (2006.01) |
| ***F42B 33/00*** | (2006.01) |
| ***F42B 14/00*** | (2006.01) |
| ***F42B 12/36*** | (2006.01) |
| ***F42B 12/78*** | (2006.01) |
| ***F42B 12/02*** | (2006.01) |

(56) References Cited

U.S. PATENT DOCUMENTS

| | | | | |
|---|---|---|---|---|
| 40,153 | A | 10/1863 | Billings | |
| 2,322,751 | A | 6/1943 | Studler | |
| 2,946,261 | A | 7/1960 | Crockett | |
| 3,230,886 | A * | 1/1966 | Woodring | F42B 12/78 102/507 |
| 3,348,486 | A | 10/1967 | Rapp | |
| 3,913,489 | A | 10/1975 | Trevor et al. | |
| 3,952,657 | A | 4/1976 | Kaltmann | |
| 5,686,693 | A | 11/1997 | Jakobsson | |
| 6,305,293 | B1 | 10/2001 | Fry et al. | |
| 6,317,946 | B1 | 11/2001 | Beal | |
| 6,439,125 | B1 | 8/2002 | Carter | |
| 7,207,275 | B1 | 4/2007 | Oertwig | |
| 7,219,607 | B2 | 5/2007 | Oertwig | |
| 7,222,573 | B2 | 5/2007 | Pontieri | |
| 7,451,706 | B2 | 11/2008 | Meyer | |
| 7,748,325 | B2 | 7/2010 | Marx | |
| 7,900,561 | B2 | 3/2011 | Marx | |
| 8,082,850 | B2 * | 12/2011 | Marx | F42B 10/26 102/501 |
| 8,267,015 | B2 * | 9/2012 | Marx | F42B 10/26 102/501 |
| 2005/0183617 | A1 | 8/2005 | MacDougall | |
| 2006/0027128 | A1 | 2/2006 | Hober | |
| 2007/0089628 | A1 | 4/2007 | Elder | |
| 2007/0089629 | A1 | 4/2007 | Marx | |
| 2010/0224093 | A1 * | 9/2010 | Wilhelm | F42B 12/74 102/507 |

OTHER PUBLICATIONS

International Preliminary Report on Patentability issued Dec. 11, 2014 for corresponding PCT International Application No. PCT/US2013/043081 with an International Filing Date of May 29, 2013.

* cited by examiner

HIGH VOLUME MULTIPLE COMPONENT PROJECTILE ASSEMBLY

BACKGROUND OF THE INVENTION

1. Field of the Invention

This invention relates to ammunition. More specifically, it relates to a projectile that is advantageously deformed by rifling.

2. Brief Description of the Related Art

Projectiles that include a head and a tail held together by an interface have enhanced performance characteristics relative to conventional projectiles.

However, the rifling in a gun barrel causes compression of the interface and the number of such compressions, as well as the location, depth and longitudinal extent of the compression is essentially uncontrollable, thereby reducing the effectiveness of the projectile. Accordingly, multiple projectiles fired in sequence will follow differing paths of travel due to the random quantity, location, depth and extent of the compressions formed in the interface.

The conventional wisdom is that such compression is a natural consequence of rifling and that nothing can be done about it.

In view of the art considered as a whole at the time the present invention was made, it was not obvious to those of ordinary skill in the field of this invention that the effects of random rifling compressions could be reduced or eliminated. Thus it was not obvious how such effects could be reduced or eliminated.

BRIEF SUMMARY OF THE INVENTION

The long-standing but heretofore unfulfilled need for a projectile that is not subject to the limitations of prior art projectiles is now met by a new, useful, and nonobvious invention.

In all embodiments, the novel structure includes a head, a tail, and an interface that interconnects the head and tail.

In a first embodiment, the head includes a frusto-conical section that extends from a leading end of the head to a point about mid-length of the head. A diameter-reducing annular step is formed about mid-length of the head.

The depth of the diameter-reducing annular step is equal to the thickness of the leading edge of the interface so that the leading edge of the interface abuts the diameter-reducing annular step and an exterior surface of the interface is flush with an exterior surface of the head.

A first annular ridge is formed in the head in trailing, longitudinally spaced apart relation to the diameter-reducing annular step. Accordingly, a first annular recess extends longitudinally from the diameter-reducing annular step to the first annular ridge.

A second annular ridge is formed in the head in trailing and longitudinally spaced apart relation to the first annular ridge, forming a second annular recess between the interface and the head that extends from the first annular ridge to the second annular ridge.

A third annular recess extends from the second annular ridge to the trailing edge of the head.

A third annular ridge is formed in a leading end of the tail.

The interface has an open leading end, a closed trailing end, an exterior surface, and a cavity defined by an interior surface. The closed trailing end has a flat exterior bottom wall and a flat interior bottom wall. An annular diameter-increasing step is formed in the interior surface of the interface about mid-length of a tail-receiving section of the interface.

Accordingly, a fourth annular recess is formed between the interface and the tail, extending from the third annular ridge to the annular diameter-increasing step formed in the interior surface of the interface.

The interface has first, second, third and fourth annular sections that are compressed radially inwardly during manufacturing or by rifling when the projectile is fired so that said annular sections are respectively disposed in the first, second, third and fourth annular recesses so that each of the annular sections of the interface are deformed to conform to the contour of said head and tail.

All of the deformations are positioned on the leading side of the annular obturation region. The deformations are advantageous because the amount of deformation is controlled by the depth of each of the annular recesses and the longitudinal extent of each of the annular recesses. Moreover, the quantity and location of each deformation is also under the control of the projectile manufacturer. This is in sharp contrast with the deformations of the prior art that are random in number, location, depth and extent and which therefore produce random flight paths for projectiles fired in sequence.

In a second embodiment, only one annular recess and one annular ridge is formed in the head. The annular ridge is formed in the trailing end of the head and the annular recess is formed in the head in leading relation to the annular ridge and in longitudinally spaced apart relation to the annular diameter-reducing step formed in the head. In this embodiment, the annular diameter-reducing step is formed in the head about one-third the distance from its leading end to its trailing end.

In the second embodiment, as in the first embodiment, an annular recess extends from the annular diameter-increasing step formed in the interior surface of the interface to the leading end of the tail. This annular recess extends about half the length of the tail.

A third embodiment is similar to the second because it includes one annular recess and one annular ridge formed in the head. The annular ridge is formed in the trailing end of the head as in the second embodiment but the annular recess formed in the head in leading relation to the annular ridge extends to the annular diameter-reducing step formed in the head, reducing gradually in depth as it approaches said annular diameter-reducing step. As in the second embodiment, the annular diameter-reducing step is formed in the head about one-third the distance from the leading end of the head to its trailing end.

In the third embodiment, as in the second embodiment, a second annular recess extends from the annular diameter-increasing step formed in the interior surface of the interface to the trailing wall of the head, i.e., to the annular ridge formed in the trailing end of the head.

In all embodiments, the exterior surface of the interface has a flat trailing end, a uniform diameter mid-section, and an open leading end that reduces slightly in diameter relative to the mid-section. The diameter of the mid-section is also slightly greater than the diameter of the trailing end. This difference in diameter creates an interface transition region between the trailing end of the interface and the uniform diameter mid-section.

An annular inflection or obturation region is formed in the interface transition region.

The open leading end of the interface has a beveled edge that guides the tail into the cavity of the interface when the tail is dropped into the cavity. Therefore there is no need for a time-consuming precise alignment between the open end of the interface and the tail. The trailing end of the tail is in spaced apart relation to the flat bottom wall of interface cavity when the tail is dropped into the interface cavity.

A ram has a frusto-conical cavity that matches the slope of the frusto-conical section of the head. The head and tail are pushed into the interface by the ram until the flat trailing wall of the tail abuts the flat interior bottom wall of the interface.

A radially inward crimp is formed in the open leading end of the interface after the tail and head have been inserted into the cavity of the interface. The crimp abuts the diameter-reducing step formed in the head.

In all embodiments, the interface is compressed into the annular recesses either prior to projectile firing or during such firing, there being four such annular recesses in the first embodiment and two such annular recesses in the second and third embodiments. However, since the quantity, location, depth, longitudinal extent of each annular recess is determined by the projectile manufacturer, the depressions formed in the interface are under the control of said manufacturer.

All embodiments eliminate the random number, random depth, random length, and random location of rifle-created depressions that are formed in prior art projectiles.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
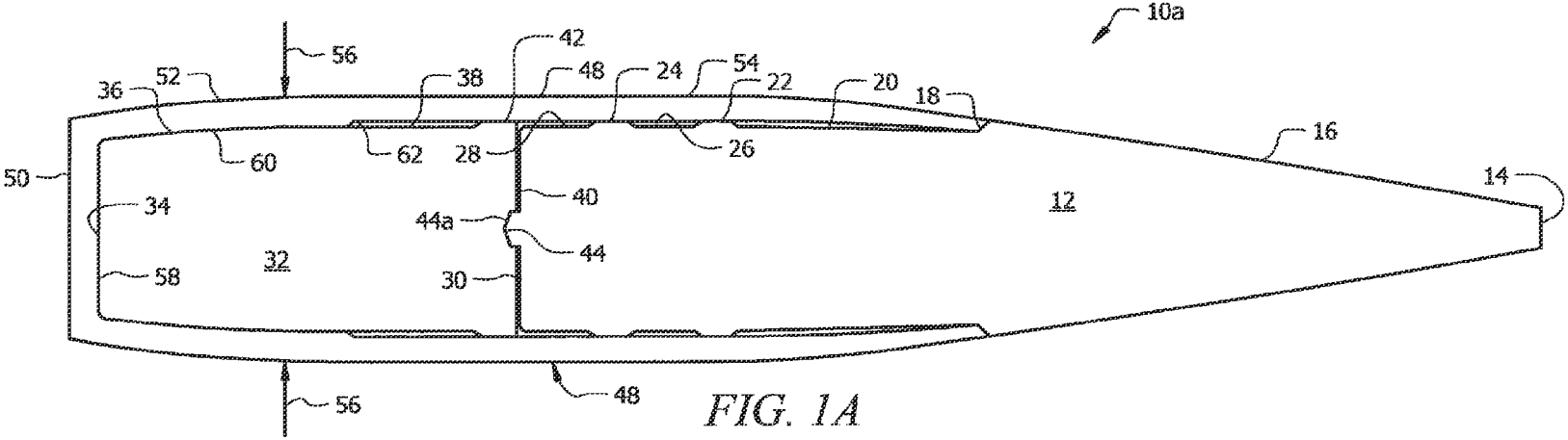
FIG. 1A is a longitudinal sectional view of a first embodiment of the novel projectile assembly.

A first embodiment of the novel structure is denoted as a whole in FIG. 1A by the reference numeral 10*a*.

Structure 10*a* includes head 12, tail 32, and interface 48. Head 12 is depicted individually in FIG. 1B, tail 32 is depicted individually in FIG. 1C, and interface 48 is depicted individually in FIGS. 4A and 4B.

Leading end 14 of head 12 can be flat as depicted, rounded, or pointed. Frusto-conical section 16 extends from leading end 14 to a point about mid-length the length of said head. Diameter-reducing annular step 18 is formed at said location and the diameter of head 12 is reduced from said step 18 to the trailing end of said head. The reduced diameter increases slightly but linearly as at 20 from said annular step 18 to first transversely disposed annular ridge 22. The diameter of head 12 is uniform from first ridge 22 to second transversely disposed annular ridge 24 and is again uniform until it reaches flat trailing wall 30.

The leading end of interface 48 abuts diameter-reducing annular step 18 and an interior surface of said interface is spaced apart from head 12 by the first and second transversely disposed annular ridges 22 and 24, thereby creating first, second and third annular recesses 20, 26 and 28.

Three annular recesses are thus created between interface 48 and head 12, said three spaces being denoted 20, 26, and 28.

Figure 1B:
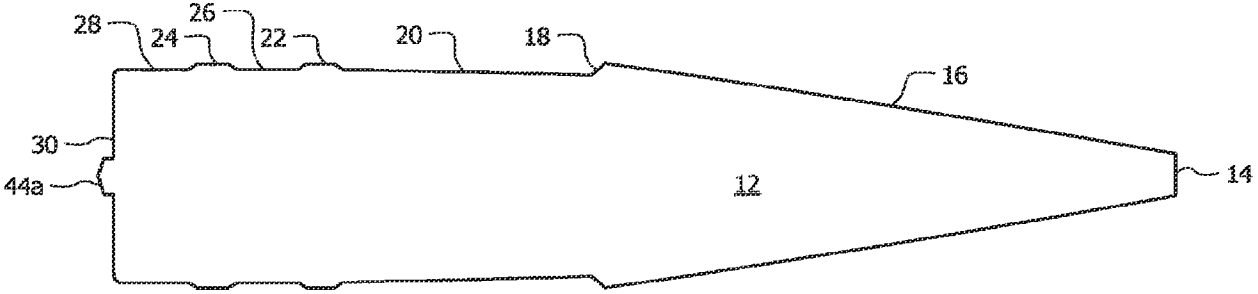
FIG. 1B is a longitudinal sectional view of the projectile head of the first embodiment.
Figure 1C:
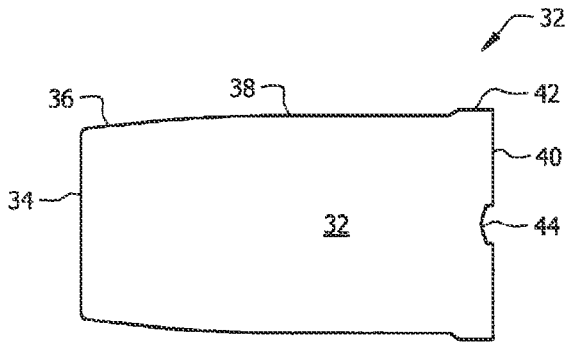
FIG. 1C is a longitudinal sectional view of the projectile tail of the first embodiment.

Tail 32, depicted in side elevation in FIGS. 1A and 1C, is preferably, for manufacturing purposes, a wire that is cold formed by being punched into a die cavity. The exterior surface of tail 32 therefore conforms to the shape of the die cavity. Tail 32 includes flat trailing wall 34, transition region 36 where its diameter increases slightly, uniform diameter section 38, and leading wall 40. The tail diameter increases at annular ridge 42 at the leading end of said tail.

Central concavity 44 formed in flat leading wall 40 is formed by a mirror image protuberance at the leading end of a ram that drives tail 32 into its die.

FIG. 1B depicts head 12 of the first embodiment. It is preferably machined on a lathe although any other suitable manufacturing means is within the scope of this invention.

Figure 1D:
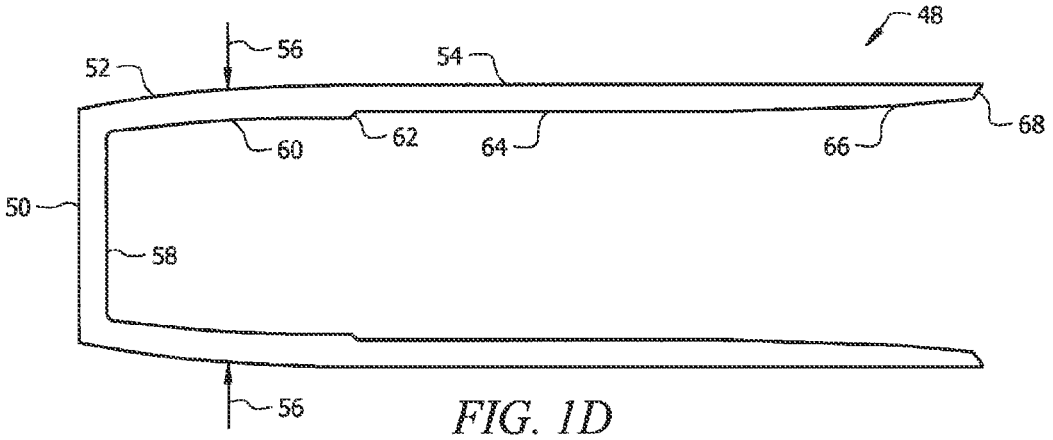
FIG. 1D is a longitudinal sectional view of the interface prior to assembly.
Figure 1E:
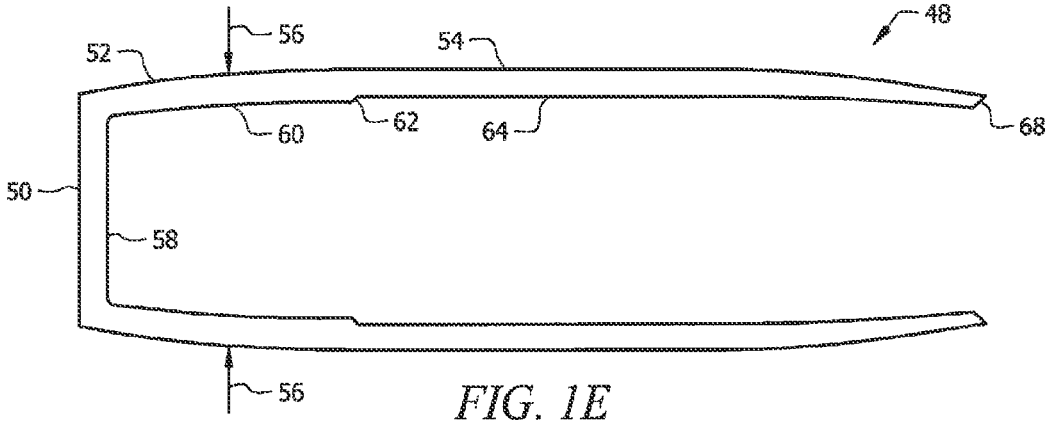
FIG. 1E is a longitudinal sectional view of the interface after assembly.

FIG. 1D depicts interface 48 prior to assembly and FIG. 1E depicts interface 48 after assembly, i.e., as it appears in FIG. 1A.

Interface 48 is cold formed by positioning a flat coin over a die having a cavity formed therein and by punching the coin into said cavity with a ram. The contour of the cavity determines the exterior shape of interface 48 and the contour of the ram determines the interior shape of interface 48.

The bottom wall of the cavity is flat, thereby forming flat exterior trailing end 50 and the leading end of the ram is flat, thereby forming interior flat bottom wall 58. The diameter of the cavity has its most narrow dimension at said bottom wall. A cavity diameter transition region is provided where the interior and exterior diameter of the cavity increases slightly as it extends away from said bottom wall, thereby forming interface transition region 52 in the exterior surface of interface 48. The diameter of the cavity is uniform from the opening of the cavity to said cavity diameter transition region, thereby forming uniform diameter region 54 of said interface.

The annular inflection point that marks the transition from increasing diameter section 52 to uniform diameter section 54 is indicated by confronting arrows 56 in FIGS. 1D and 1E. This annular region is known in the industry as the obturation point, band, or region.

The leading end of the ram is flat so that it forms flat interior surface 58 as aforesaid. The contour of the leading end of the ram produces curved interior surface 60 and an increase in diameter at a location away from its flat leading end produces annular diameter-increasing step 62 in the interior surface of interface 48.

An annular recess is thus created between interface 48 and tail 32, said annular recess being denoted 38 in FIG. 1A. This is the fourth annular recess in the first embodiment of the novel assembly and it extends from annular ridge 42 formed in tail 32 to said annular diameter-increasing step 62.

Thus, in the embodiment of FIG. 1A, there are four annular recesses formed between interface 48, head 12 and tail 32 with three of the four being between the interface and head 12.

As best understood in connection with FIG. 1D, the undepicted ram has a uniform diameter towards its leading end relative to annular step 62 to produce uniform diameter section 54 in interface 48. The ram then increases in diameter linearly to produce linearly diverging section 66 at the leading, open end of interface 48.

The open leading end of interface 48 is beveled as at 68 (FIGS. 1D and 1E). The bevel helps guide tail 32 into the hollow interior or cavity of interface 48 when said tail is dropped thereinto. More particularly, after interface 48 has been cold-formed from a flat coin at a first station by the punch and die, it is displaced by a conveyor or other suitable means to a second station where tail 32 is dropped thereinto from an overhead bowl or other device. Thus there is no need for a time-consuming precise alignment between the open end of interface 48 and tail 32.

Trailing end 34 of tail 32 will not abut flat bottom wall 58 of interface 48 when said tail 32 is dropped into said interface. Head 12 is dropped into the interface after tail 32 and flat trailing wall 30 of head 12 abuts leading wall 40 of tail 32 as depicted. An undepicted protuberance formed in the trailing wall 30 of head 12 fits into concavity 44. This eliminates the need to remove said protuberance.

The undepicted ram having a frusto-conical cavity that matches the slope of frusto-conical section 16 of head 12 pushes head 12 and tail 32 into interface 48 until flat trailing wall 34 of tail 32 abuts flat bottom wall 58 of interface 48. Interface 48 is then crimped at its open leading end so that it assumes its FIG. 1A and FIG. 1E configuration.

As depicted in FIG. 1A, the above-disclosed contours create transversely disposed annular recesses 20, 26, 28, and 38 when head 12 and tail 32 are fully received within interface 48. Interface 48 is compressed radially inwardly by rifling when the projectile is fired so that it occupies each of said annular recesses. The radially inward compression may also be made during the manufacturing process. All compressions/deformations of interface 48 are on the leading side of obturation region 56. This compression is advantageous because it is a controlled deformation, as distinguished from a prior art random, uncontrolled deformation. The result is a projectile that more consistently hits its aiming point.

Figure 2A:
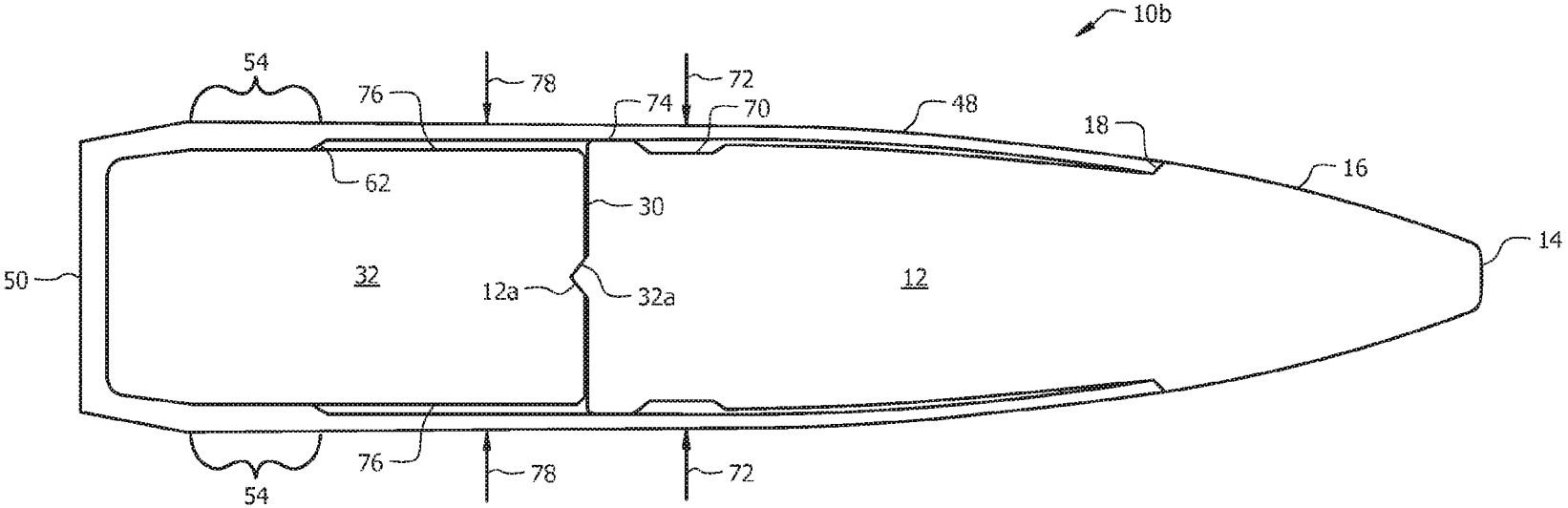
FIG. 2A is a longitudinal sectional view of a second embodiment of the novel projectile assembly.
Figure 2B:
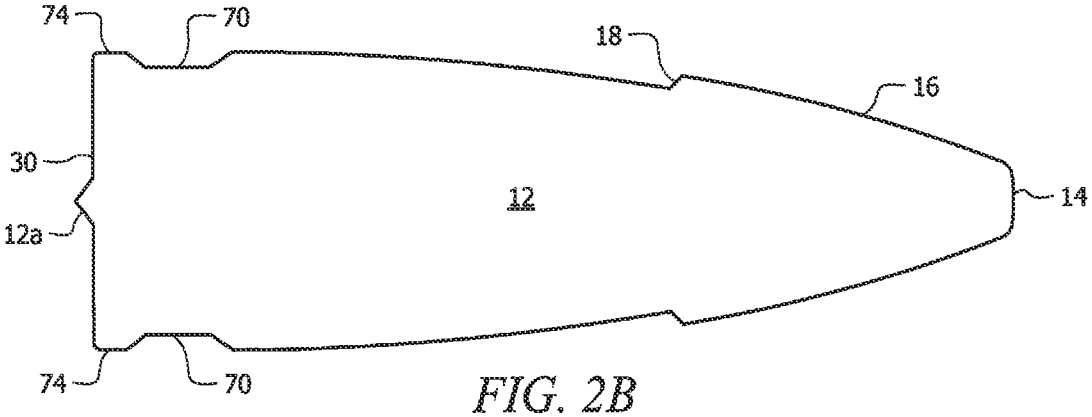
FIG. 2B is a longitudinal sectional view of the projectile head of the second embodiment.
Figure 2C:
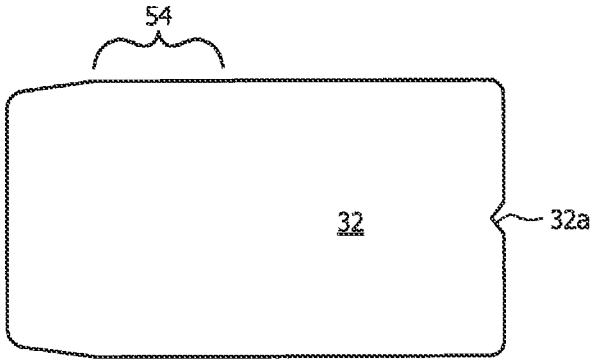
FIG. 2C is a longitudinal sectional view of the projectile tail of the second embodiment.

Referring now to the second embodiment, depicted in FIGS. 2A-C, instead of three (3) annular recesses between head 12 and interface 48 as in the first embodiment, there is but one (1) annular recess, denoted 70, formed in head 12 Annular recess 70 is formed in head 12 in leading relation to drive chamfer 74 which is provided in the form of an annular raised ridge formed in the trailing end of head 12, in trailing relation to annular recess 70. Drive chamfer 74 imparts spin to head 12.

In this second embodiment, interface 48 is pre-compressed radially inwardly into annular recess 70 during assembly as indicated by directional arrows 72. The compression is produced by a cannelure die that also produces a bullet knurl with symmetrically arranged pronged teeth. A wheel die would deform the bullet shape.

In this second embodiment, annular diameter-reducing step 18 is formed in head 12 about one-third of the way from its flat leading end 14 to its flat trailing end 30. As in the first embodiment, the leading end of interface 48 has a thickness equal to the depth of step 18 so that an exterior surface of head 12 is flush with an exterior surface of interface 48.

The internal diameter of interface 48 in this second embodiment increases at diameter increasing step 62 so that annular recess 76 is created between said interface and tail 32. Annular recess 76 facilitates projectile assembly by reducing friction during such assembly. After assembly, radially inwardly directed arrows 78 indicate that interface 48 is compressed into annular recess 76. The compression may be accomplished during the assembly step after tail 32 is inserted into the cavity of interface 48, or the compression may take place during firing of the round.

Obturation band 54 is denoted with a bracket to indicate its length. As in the first embodiment, the function of obturation band 54 is to seal against gas pressure leakage.

The length of obturation band 54 in inches for a copper interface 48 is calculated by dividing one thousand pounds per square inch by 500 to produce a first length such as two inches, and by dividing one thousand pounds per square inch by fifteen hundred to produce a second length such as two-thirds of an inch. The length of obturation band 54 for a copper interface is thus about one and one-third inch, beginning about two-thirds of an inch from flat trailing wall 50 of interface 48 to a point about one and one-third inch in a leading direction therefrom, i.e., to where annular interstitial space 76 begins.

Head 12 of this second embodiment is individually depicted in FIG. 2B and tail 32 is individually depicted in FIG. 2C.

Figure 3A:
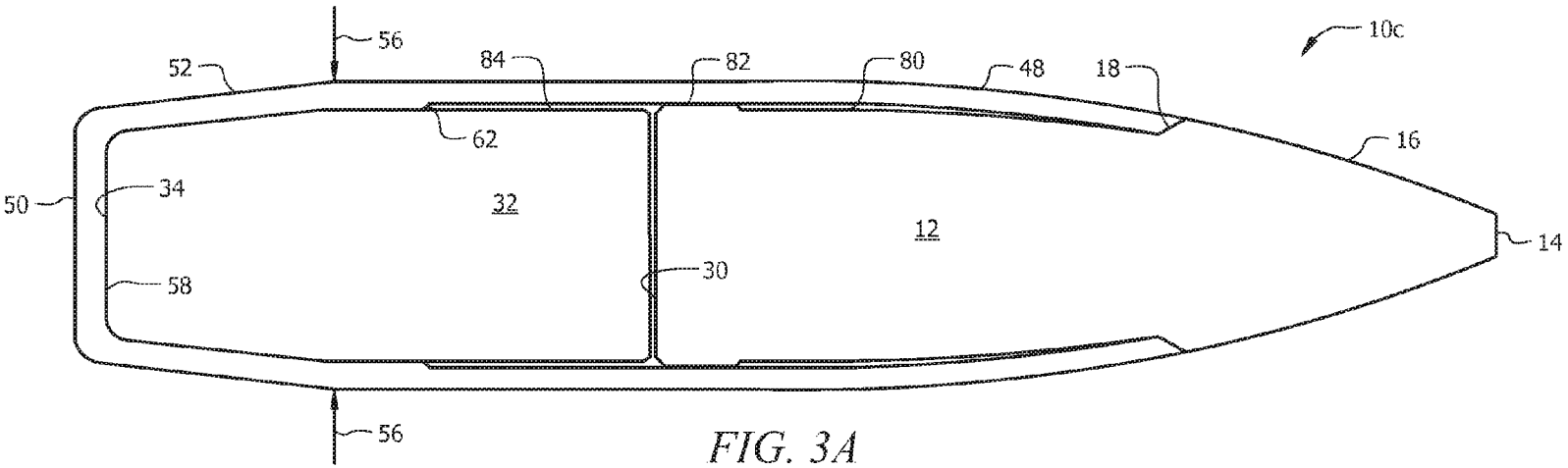
FIG. 3A is a longitudinal sectional view of a third embodiment of the novel projectile assembly.
Figure 3B:
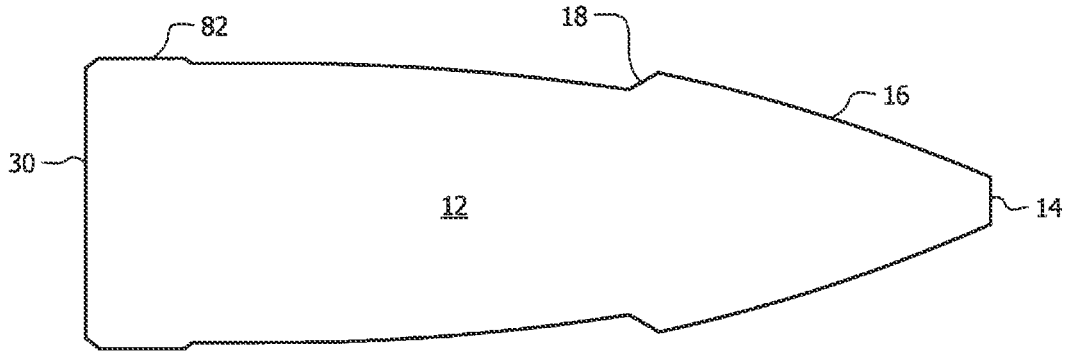
FIG. 3B is a longitudinal sectional view of the projectile head of the second embodiment.
Figure 3C:
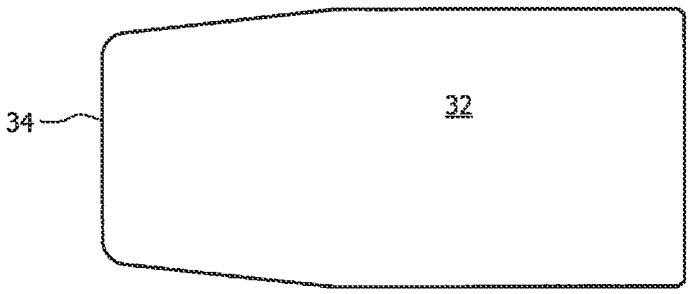
FIG. 3C is a longitudinal sectional view of the projectile tail of the third embodiment.

The third embodiment is depicted in FIGS. 3A-3C. It includes one annular recess 80 and one annular ridge 82 formed in head 12, said annular ridge 82 serving as a driving chamfer Annular ridge 82 is formed in the trailing end of head 12 as in the second embodiment but annular recess 80 formed in head 12 in leading relation to annular ridge 82 extends to or almost to annular diameter-reducing step 18 formed in head 12. As in the second embodiment, annular diameter-reducing step 18 is formed in head 12 about one-third the distance from the leading end of the head to its trailing end. The depth of annular recess 80 gradually reduces as it approaches annular diameter-reducing step 18.

Second annular recess 84 extends from annular diameter-increasing step 62 formed in the interior surface of interface 48 to the leading end of tail 32, i.e., to annular ridge 82 formed in the trailing end of head 12.

Head 12 of this third embodiment is individually depicted in FIG. 3B and tail 32 is individually depicted in FIG. 3C.

It will be seen that the advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A projectile, comprising:

a head, a tail, and a cup-shaped interface defining a cavity that receives the tail, then the head and -interconnects the head and tail in an assembled configuration;

the head having a leading tip, midsection and trailing end;

the interface having an exterior and interior, the interface having an open leading end securing the head and a closed trailing end securing the tail whereby the interface and tail are dimensioned so that the tail may be dropped into the interface cavity and fall to its assembled configuration by gravity at the closed trailing end of the interface;

the diameter of the trailing end of the head being greater than at least one portion of the midsection of the head whereby a first interstitial space is formed between the interior of the interface and the at least one portion of the midsection of the head upon assembly;

the tail having a leading end abutting the trailing end of the head and a trailing end of the tail abutting the closed trailing end of the interface;

the diameter of the leading end of the tail having a diameter less than the interior diameter of the interface whereby a second interstitial space is formed between the interior of the interface and the leading end of the tail upon assembly;

whereby, upon firing of the projectile, the interface is deformed a preselected amount by being compressed radially inwardly whereby the volume of the first and second interstitial spaces are reduced.

2. The projectile of claim 1, further comprising:

the longitudinal extent of the interstitial spaces being defined by annular ridges formed in the head, the tail, or both the head and tail.

3. The projectile of claim 1, further comprising:

said interface including an annular obturation region.

4. The projectile of claim 3, further comprising:

said interface having a beveled open leading end to facilitate insertion of the head and tail into the interface.

5. The projectile of claim 1, further comprising:

said interstitial spaces being formed between the interface and the head and tail during manufacturing of the projectile.

6. A projectile, comprising:

a head, a tail, and an interface that interconnects the head and the tail;

a diameter-reducing annular step of predetermined depth formed in the head;

the interface having an open leading end, a closed trailing end, an exterior surface, and a cavity defined by an interior surface;

a diameter-increasing annular step formed in the interior surface of the interface, the diameter-increasing annular step increasing the diameter of the cavity;

the diameter-increasing annular step creating a first annular space between a predetermined extent of the tail and the interface extending from the diameter-increasing annular step formed in the interior surface of the interface and the leading end of the tail that abuts the head;

the exterior surface of the interface having a flat trailing end, a uniform diameter mid-section, a trailing section that extends from the flat trailing end to the uniform diameter mid-section and which gradually increases in diameter;

an annular obturation region formed where the trailing section and the uniform diameter mid-section merge with one another;

a leading end of the interface abutting the diameter-reducing annular step when the projectile is assembled, the leading end of the interface having a thickness equal to the predetermined depth of the diameter-reducing annular step so that an exterior surface of the head and an exterior surface of the interface are flush with one another when the projectile is in its assembled configuration;

an annular ridge of predetermined height and extent formed in a trailing end of the head, the annular ridge being a drive chamfer; and an annular recess of predetermined depth and extent formed in the head in leading relation to the drive chamfer forming a second annular space between the drive chamfer of the head and the diameter-reducing annular step in the head;

the interface being compressed radially inwardly at the first annular space and second annular space by the rifling of a barrel upon firing of the projectile; and whereby a plurality the projectiles follow a substantially common path of travel when fired sequentially because each projectile of the plurality of projectiles has an interface having a common quantity, location, annular extent, longitudinal extent and depth of compressed areas.

* * * * *